US011969068B2

(12) United States Patent
Hurter

(10) Patent No.: US 11,969,068 B2
(45) Date of Patent: Apr. 30, 2024

(54) CORDLESS NAIL GEL CURING LAMP WITH INTERCHANGEABLE SURFACE FEATURES

(71) Applicant: Kupa, Inc., Anaheim, CA (US)

(72) Inventor: Richard B. Hurter, Castaic, CA (US)

(73) Assignee: Kupa, Inc., Anaheim, CA (US)

( * ) Notice: Subject to any disclaimer, the term of this patent is extended or adjusted under 35 U.S.C. 154(b) by 952 days.

(21) Appl. No.: 16/936,226

(22) Filed: Jul. 22, 2020

(65) Prior Publication Data

US 2021/0022473 A1 Jan. 28, 2021

Related U.S. Application Data

(60) Provisional application No. 62/878,691, filed on Jul. 25, 2019.

(51) Int. Cl.
*A45D 29/00* (2006.01)

(52) U.S. Cl.
CPC ..... *A45D 29/00* (2013.01); *A45D 2200/205* (2013.01)

(58) Field of Classification Search
CPC ..... A45D 29/00; A45D 2200/205
USPC ..... 34/275
See application file for complete search history.

(56) References Cited

U.S. PATENT DOCUMENTS

D232,327 S 8/1974 Waters et al.
D702,400 S 4/2014 Valia et al.
8,993,983 B2 * 3/2015 Li ..... F21V 7/00 132/73
D734,548 S 7/2015 Dadon
D747,828 S 1/2016 Vu et al.
9,351,555 B2 5/2016 Li et al.
D765,314 S 8/2016 Loibl
D777,981 S 1/2017 Oh
(Continued)

FOREIGN PATENT DOCUMENTS

CN 203969578 U 12/2014
CN 305423338 11/2019
(Continued)

OTHER PUBLICATIONS

"Extended European Search Report," European Patent Appln. No. EP20187689.3, dated Nov. 17, 2020, 8 pages, European Patent Office, Munich, Germany.
(Continued)

*Primary Examiner* — Stephen M Gravini
(74) *Attorney, Agent, or Firm* — STETINA BRUNDA GARRED & BRUCKER

(57) ABSTRACT

The present inventive subject matter relates to a portable electronic device housing having an opening for receiving a hand or foot wherein the housing has interior positioned LEDs for emitting light onto the nails of the hand or foot to cure nail care preparations applied thereto. The device includes removably attachable top and bottom trim to which can be substituted with different top and bottom trim for different visual appearances. In addition, the disclosed device includes a slidably attached base plate that is movable to a first position for curing of fingernails of the hand and is movable to a second position for curing of toenails of the foot. The base plate includes protrusions for a tactile indicator to a user of proper positioning of a hand.

21 Claims, 7 Drawing Sheets

(56) References Cited

U.S. PATENT DOCUMENTS

| | | | | |
|---|---|---|---|---|
| 9,625,111 | B2 * | 4/2017 | Zhang | F21V 21/30 |
| 9,707,537 | B2 | 7/2017 | Haile | |
| 9,810,479 | B2 | 11/2017 | Haile et al. | |
| 9,855,543 | B2 | 1/2018 | Haile | |
| 9,894,975 | B2 | 2/2018 | Huang | |
| 10,016,043 | B1 | 7/2018 | Cheng | |
| D838,042 | S | 1/2019 | Ouyang | |
| 10,264,866 | B1 | 4/2019 | Luu | |
| D857,993 | S | 8/2019 | Hsieh et al. | |
| 10,393,433 | B2 * | 8/2019 | Valia | A45D 29/00 |
| D858,883 | S | 9/2019 | Wu et al. | |
| 10,408,537 | B2 * | 9/2019 | Haile | A45D 29/00 |
| D872,369 | S | 1/2020 | Le | |
| D880,068 | S | 3/2020 | Wu et al. | |
| D890,431 | S | 7/2020 | Hsieh et al. | |
| 10,876,791 | B2 | 12/2020 | Valia et al. | |
| 11,540,374 | B1 * | 12/2022 | Tan | F21V 31/00 |
| 2010/0293805 | A1 * | 11/2010 | Chang | A45D 29/00 34/202 |
| 2011/0277338 | A1 | 11/2011 | Li et al. | |
| 2012/0060757 | A1 | 3/2012 | Ji et al. | |
| 2013/0134447 | A1 | 5/2013 | Pan et al. | |
| 2015/0082654 | A1 * | 3/2015 | Jaegal | A45D 29/00 34/275 |
| 2016/0095409 | A1 | 4/2016 | Jih | |
| 2017/0006993 | A1 * | 1/2017 | Rivero | A45D 29/00 |
| 2017/0127790 | A1 | 5/2017 | Huang | |
| 2018/0302967 | A1 | 10/2018 | Hsieh et al. | |
| 2020/0237071 | A1 * | 7/2020 | Lee | A45D 29/00 |

FOREIGN PATENT DOCUMENTS

| | | | | |
|---|---|---|---|---|
| DE | 202006015288 | U1 | 1/2007 | |
| EP | 3769643 | A1 * | 1/2021 | A45D 29/00 |
| TW | M549557 | | 10/2017 | |
| WO | WO-2013149156 | A2 * | 10/2013 | A45D 29/00 |

OTHER PUBLICATIONS

Kupa, Inc. Website, "UV/LED Hybrid Lamp—WHT.," https://kupainc.com/products/gelfinity-uv-led-hybrid-lamp-white, publication date unknown, site visited Jul. 27, 2020.

* cited by examiner

CORDLESS NAIL GEL CURING LAMP WITH INTERCHANGEABLE SURFACE FEATURES

CROSS-REFERENCE TO RELATED APPLICATIONS

The present application claims the benefit of U.S. Provisional Application No. 62/878,691, filed Jul. 25, 2019, the contents of which are expressly incorporated herein by reference.

STATEMENT RE: FEDERALLY SPONSORED RESEARCH/DEVELOPMENT

Not Applicable

BACKGROUND

Technical Field

The present inventive subject matter relates generally to a portable nail gel curing lamp for nail gel, artificial nails and nail polish applied nails of the hand and foot. More particularly, the present inventive subject matter relates to an electronic device having an opening for receiving a hand or foot and having interior LED light sources for emitting light onto the nails of the hand or foot to cure nail care preparations applied thereto.

Background

Nail care service providers such as nail salons provide services related proving manicures and pedicures. Typically, as part of the manicure and pedicure services, service providers coat their customer's fingernails and toenails with nail gel, artificial nails and nail polish. Many of the nail finishes require drying or curing for the best results, and as such, the light nail curing devices, generally known as gel curing lamps have become standard equipment in today's nail salons.

One such device is the KUPA® gelfinity which has been offered by Kupa, Inc. of Anaheim, CA The KUPA gelfinity is a 36 Watt UV/LED lamp that cures both UV and LED products. A built-in timer allows the user to select to adjust drying or curing times depending the length of desired drying or curing time. A motion detector provides an activation of the lamp when the device senses a user has inserted a hand or foot into an opening for curing or drying.

In many instances nail technicians refer to themselves as nail artists and the service providers may wish to provide their customers with a cultivated and decorative surrounding during a nail session. However, many of the gel curing lamps on the market do not provide technicians with the ability to customize the look of their manicure/pedicure equipment. Likewise, current systems may lack portability as current devices may be tethered by power chords or may be difficult or awkward to move in the workplace. As such there is a need for gel curing lamps that provide customizable exterior features to modify the exterior look of the gel curing lamps. Also, there is a need for gel curing lamps that have increased portability to allow for nail technicians and nail artists to move freely during and after providing nail salon services.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

BRIEF SUMMARY

The inventive subject matter described herein demonstrates a nail gel curing lamp having a housing with an opening. The housing has an open cavity with an inner side, wherein the inner side includes a plurality of LEDs positioned on the inner side of the open cavity. The LEDs may have a wavelength of 400 nm or other suitable wavelength for curing nail gel or other nail care products. A plurality of control modules in electrical communication with a control board of a control interface for control the operation of the LEDS. Rather than a single LED light board, several light boards are positioned within the device. The housing includes a releasably securable trim piece for attachment to the housing. The inventive subject matter includes a plurality of structurally identical releasably securable trim pieces, each having a different color or different texture. In operation, a user can customize the appearance of the gel curing lamp for esthetic reasons, including coordinating the colors of the gel curing lamp with other nail salon devices.

The inventive subject matter additionally discloses a base coupled to the housing, wherein the base comprises two elongate slots. A base plate is coupled the base of the housing via a slidable fastener received within elongate slots. Because of the plate being fastened to the base by the slidable fasteners, said base plate is movable from a first position to a second position. When the base plate is in the first position, it is positioned closer to the opening for use when curing or drying fingernails for a hand. The plate includes three protuberances that provide tactile feel for the user to confirm that the hand is in the proper place. A motion sensor can detect that a hand or foot is positioned in the housing to initiate a drying or curing session, or to indicate placement. A second position of the slide plate pushed away from the opening, is for drying or curing of toenails of a foot. In this way the food does not touch the sliding plate that is reserved for hand use only.

Retention tabs are provided hold the sliding plate in position from moving downward or dropping toward a table or other surface in which the device is positioned. The retention tabs slidably receive the plate and support the plate. In addition, side rails are positioned on each side of the plate to prevent the sliding plate from moving laterally.

The disclosed device has a rechargeable battery to increase the portability of the device since, when the battery is charged, the disclosed device does not need to be tethered to a power chord for use. The battery is retained in the top of the housing and is configured to be removed by the consumer through an easily accessible removable rest pad that serves a dual purpose of having top working or resting service, but also is used to cover the battery recess that houses the rechargeable lithium battery. The battery is designed for single direction fit, for ease of use. A handle is integrated into the housing and projects forward on the device, avoiding interference with the use of the rest pad or battery access. A user can grasp the handle and easily move the device. Although the base has a retractable plate for use with a hand in a first non-retracted position and with a foot in a second retracted position to avoid contact with a foot during a foot drying or curing session, the same is slidably secured to the base so thus making the device a unitary structure increasing portability. The device has a recharging port for recharging the battery when it is positioned in the battery recess.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
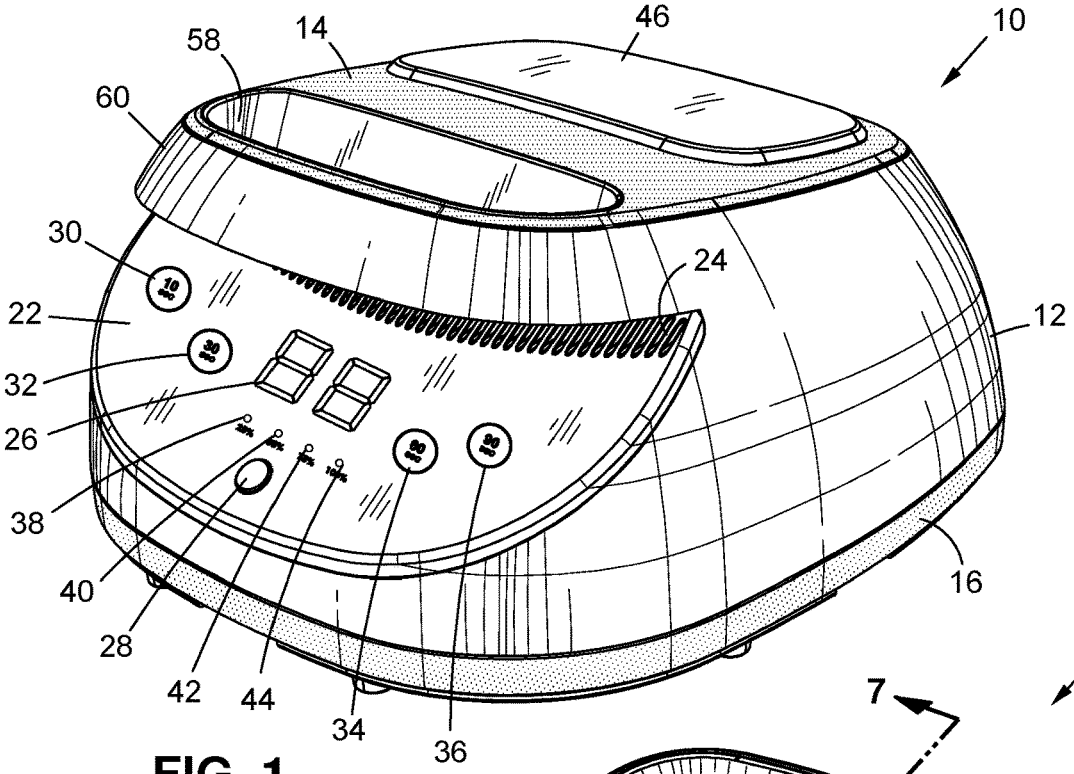
FIG. 1 is a front prospective view of the nail lamp disclosed herein.

The detailed description set forth below in connection with the appended drawings is intended as a description of certain embodiments of a cordless nail gel curing lamp apparatus, system and method and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

The background, summary and the above description includes information that may be useful in understanding the present disclosure. It is not an admission that any of the information provided herein is prior art or relevant to the presently claimed inventive subject matter, or that any publication specifically or implicitly referenced is prior art.

In some embodiments, the numbers expressing dimensions, quantities, quantiles of ingredients, properties of materials, and so forth, used to describe and claim certain embodiments of the disclosure are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the disclosure are approximations, the numerical values set forth in the specific examples are reported as precisely as practicable. The numerical values presented in some embodiments of the disclose may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the disclosure and does not pose a limitation on the scope of the claimed inventive subject matter. No language in the specification should be construed as indicating any non-claimed element essential to the practice of the inventive subject matter.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed. Various objects, features, aspects and advantages of the inventive subject matter will become more apparent from the following detailed description of preferred embodiments, along with the accompanying drawing figures in which like numerals represent like components.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

Figure 2:
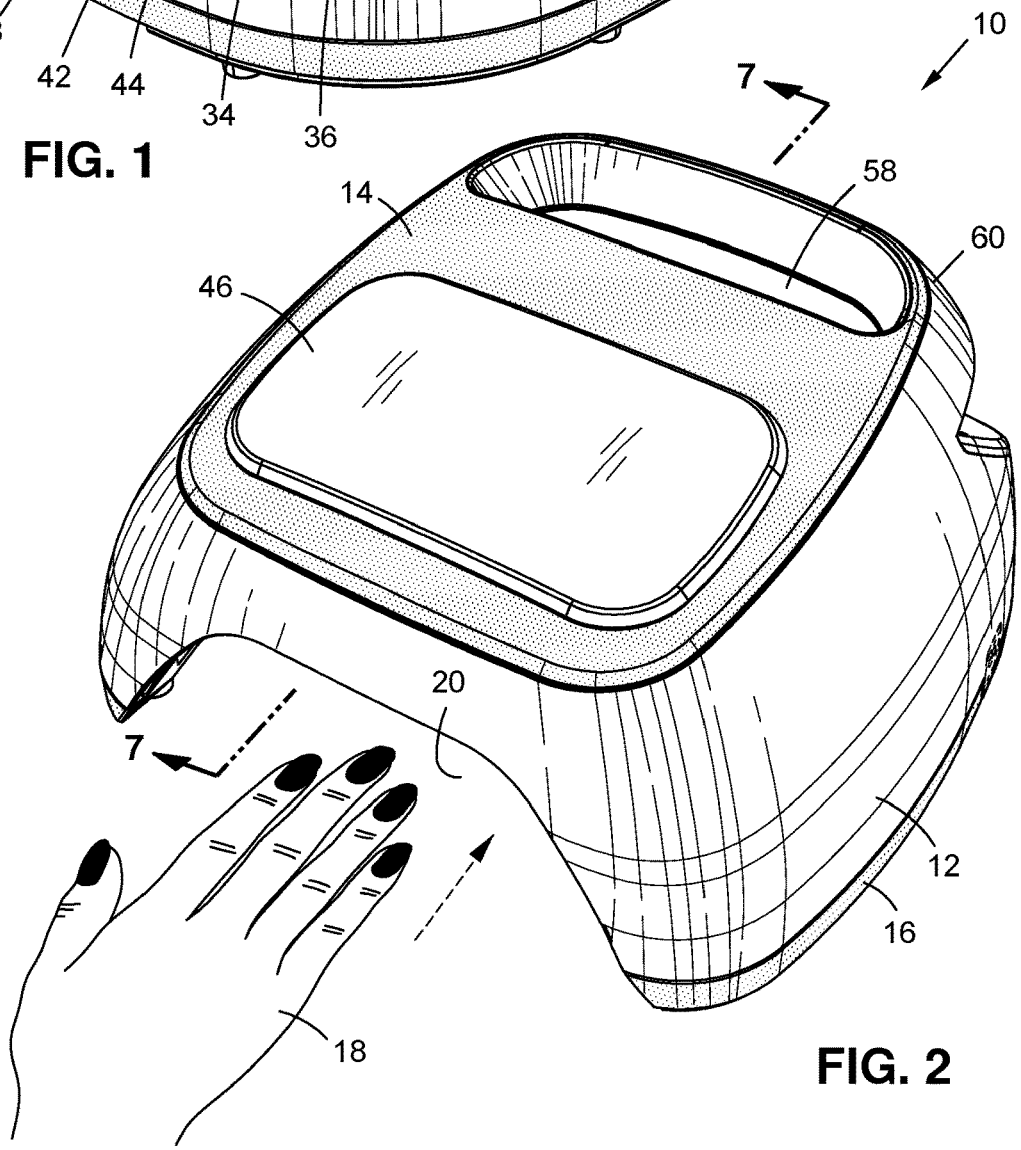
FIG. 2 is a rear prospective view of the nail lamp showing a user about to insert a hand into the nail lamp aperture.

Referring particularly to FIGS. 1 and 2, there are shown front and rear perspective views, respectively, of the disclosed nail lamp device 10. The nail lamp 10 has an exterior housing 12. A top trim piece 14 is releasably affixed to the top of the housing 12 and a bottom trim piece 16 is releasably affixed to the bottom sides of the housing 12. In operation, a user places a hand 18 or foot (not shown) into an opening 20 to place the hand or foot into the interior of the housing to expose the nails of the hand 18 or foot to LED lights (not shown) fixed within the housing 12 for drying or curing of nail care products. In some embodiments, the device 10 may have a motion detector (not shown) to determine when a hand 18 or foot is placed within the opening 20. The detector may be a motion sensor or touch sensor to determine when a hand 18 or foot is in proper position for activating LED lights and/or LED light timer for drying or curing.

As shown in FIG. 1, the lamp device 10 has a control face 22 that provides the nail technician with device controls. The control face 22 includes vents 24 positioned at the top of the control face to allow heat to escape from the interior of the device 10 during and after operation. LED lights (not show) may build up heat within the housing 12 during operation. The control face has a digital readout 26 that provides a countdown of time remaining during a drying or curing session. The disclosed digital readout 26 is an LCD read out, however, any other suitable digital readout may be utilized such as an LED readout. At the base of the control face 22, a power button 28 is provided as a mechanical switch. The mechanic switch power button 28 allows for complete shutdown of the device to save energy when the product is not in use. However, it is understood that any other type of power button could be used such as touch sensor or piezoelectric type button. Other buttons are provided to provide predetermined curing or drying times for nail products. For example, button 30 indicates "10 sec" that initiates interior LED lights for a period of ten (10) seconds to cure nail products on a customer's hand 18 or foot. For example, the LED lights emit curing light for a period of ten (10) seconds after button 30 is depressed or touched. The digital readout 26 will count down so that the technician will know the time remaining in the cure period. Also, an audible sound may be heard at the end of the cure period. In alternative embodiments the nail technician may depress or touch button 30 and the LEDs will not emit light unless and until a motion detector or some other detector determines that a hand or foot is properly positioned within the device 10. The forgoing description is equally applicable to button 32, but the time period is for thirty (30) seconds. For example, a ten (10) sec button 30 is for a soft cure, while a thirty (30) sec button 32 is for a full cure. Addition buttons 34 and 36 are provided for time periods of sixty (60) seconds and ninety (90) seconds, respectively, and may operate in the manner described with respect to the ten (10) second cure of button 30. In the disclosed embodiment of the nail lamp 10, each of the sixty (60) second (button 34) and ninety (90) second (button 36) the first portion of the cure is a soft cure during a first time period, and light intensity increases during a second period of the cure to a full cure. See for example United States Patent Publication No. US 2018/0302967 entitled Slow Start Photocuring Device and Switch Control Module published Oct. 18, 2018 to Hsieh, et al., the entire substance of which is incorporated herein by reference.

The control face 22 also has LED indicators to provide a remaining charge indication of a rechargeable battery (not shown) as a power source. For example, LED indicator 38 indicates 25% charge remaining, LED indicator 40 indicates 50% charge remaining, LED indicator 42 indicates 75% charge remaining and LED indicator 44 indicates 100% charge. While the 25% increments are disclosed, it its contemplated that different increments may be used. Also, is understood that the disclosure contemplates a different number of LED indicators, and any LED indicators could be positioned in other locations on the control face 22 or on other parts of the housing 12.

A rest pad 46 is positioned at the top of the housing 12. In use, while a customer is being prepared for curing, the user can rest one or both of their hands on the rest pad 46. The rest pad 46 which may be formed of a semi rigid material. The pad 46 may be covered with a softer material such as neoprene, or other like material. However, the rest pad 46 may be formed of any suitable material.

An opening 58 is formed in the housing 12, and the forward part of the housing with the opening 58 forms a graspable handle 60 that extends forward and above the control face 22. The handle 60 aids in creating a portable device where a user can easily grasp the handle 58 and lift the device to move the device as desired.

Figure 3:
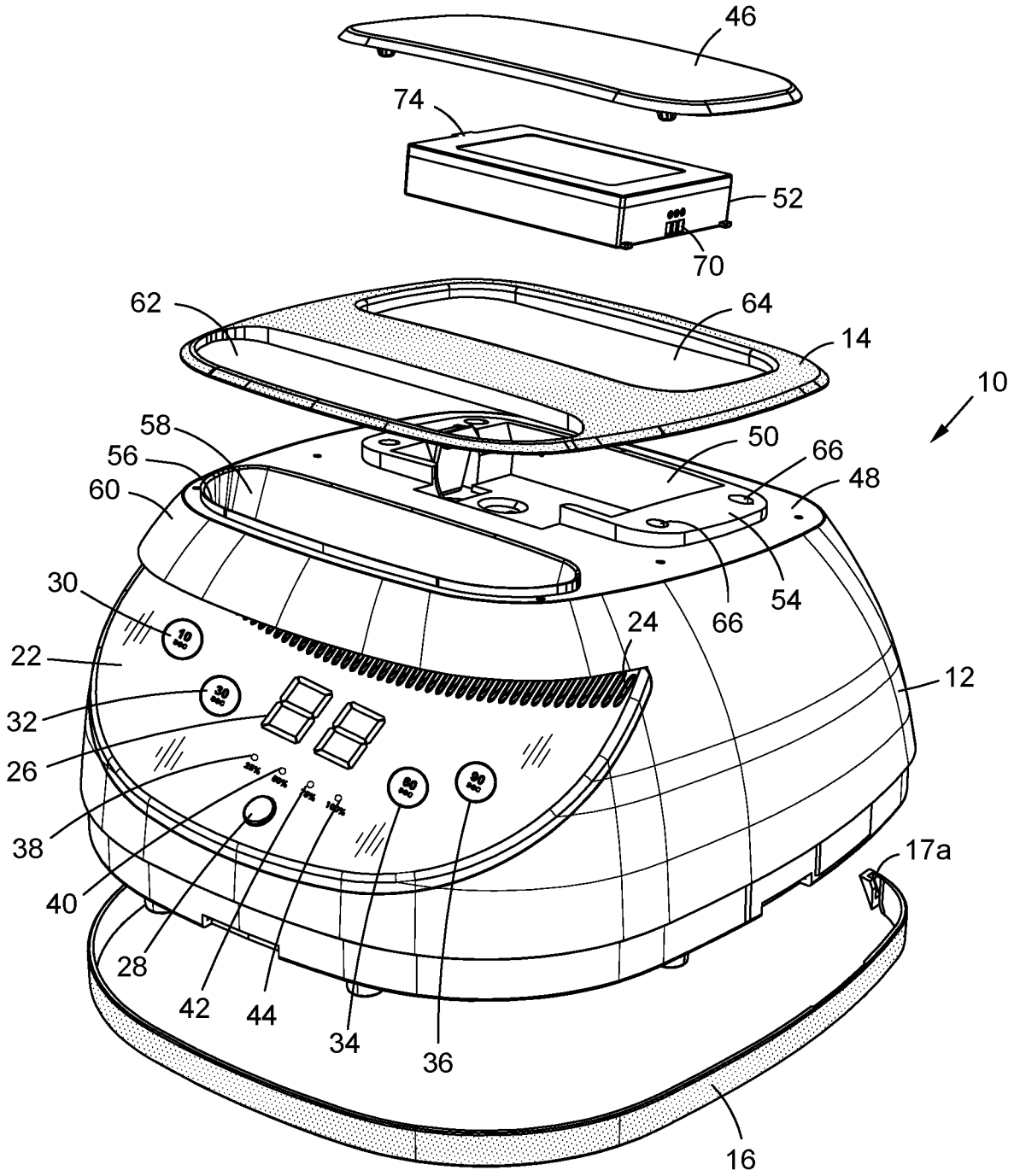
FIG. 3 is a front perspective view of the nail lamp with exploded trim pieces.
Figure 4:
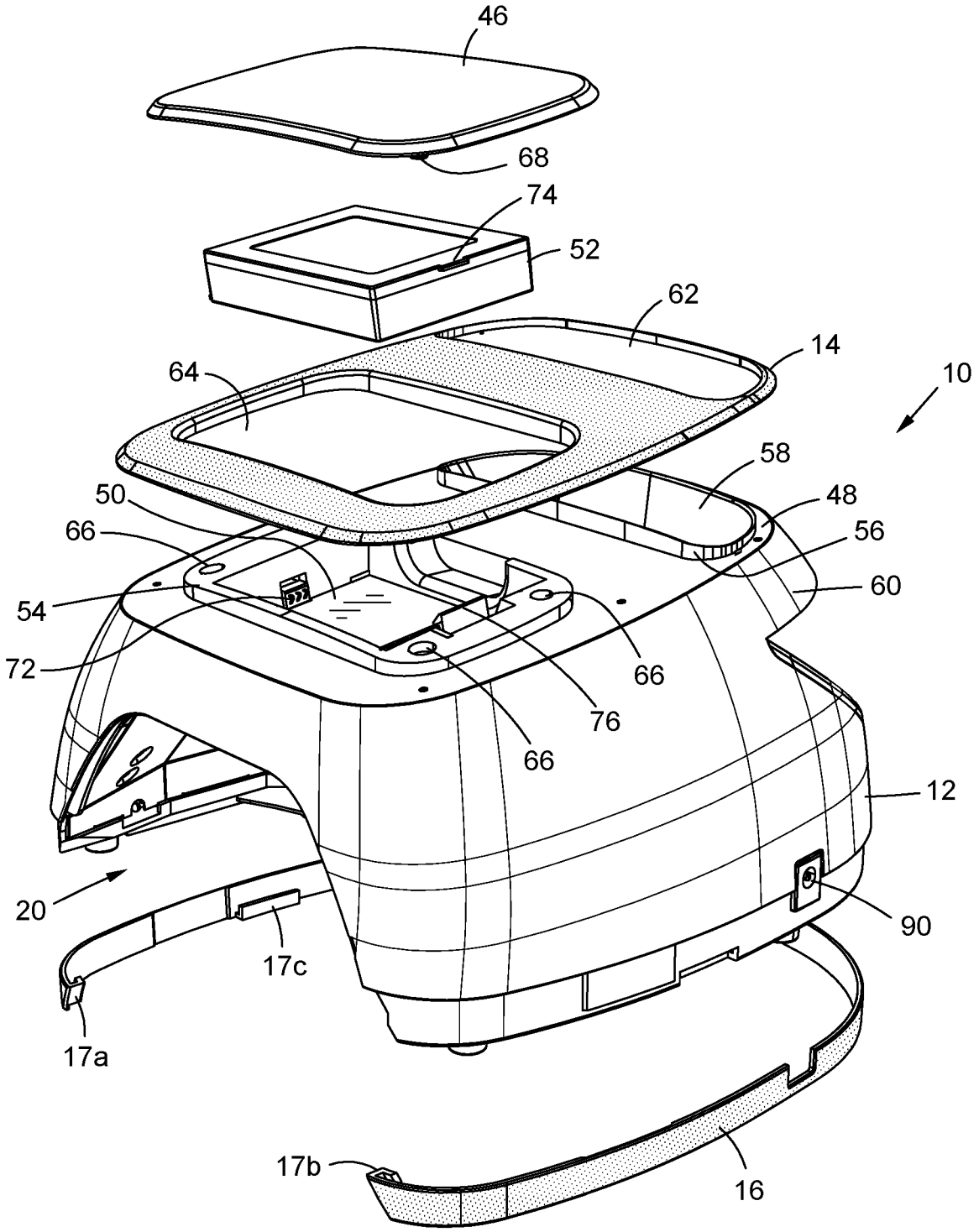
FIG. 4 is the rear perspective view of FIG. 3, with exploded trim pieces.
Figure 6:
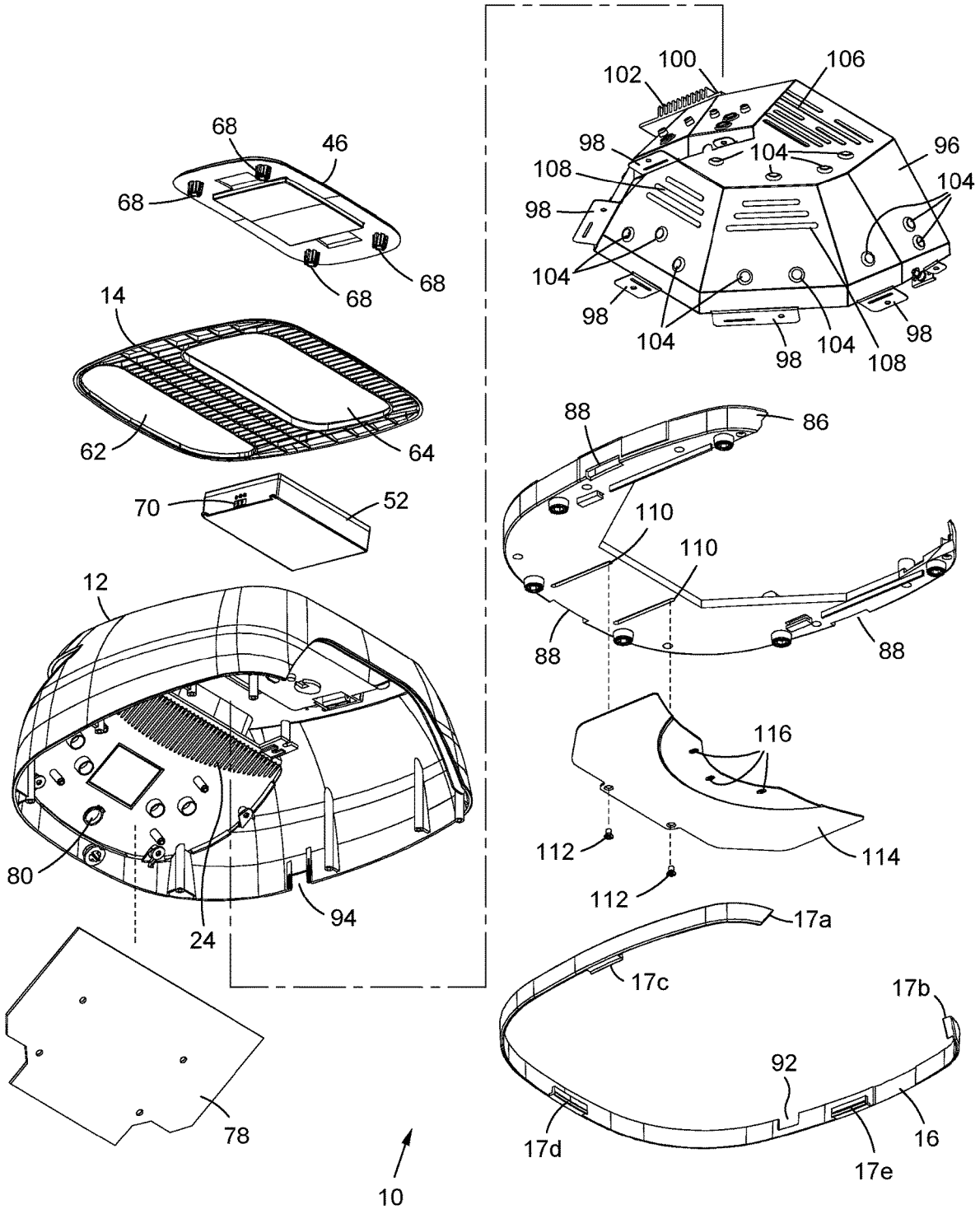
FIG. 6 is an exploded bottom perspective view of the components of the nail lamp.

Referring particularly to FIGS. 3 and 4, there are shown front and rear perspective views with user removable items exploded from the device 10. For example, the top trim 14 and bottom trim 16 are designed to be removably replaceable with identically formed top and bottom trim items of different colors or textures so that a user can replace out the trim 14 and/or 16 to give the device 10 a different appearance. As such, a user could remove trim 14 and 16 and replace them with different trims 14 and 16 having a different color or surface texture to create a different look for the device 10. Referring specifically to bottom trim 16, has end grooves 17*a* and 17*b* to snap fit on the bottom of the housing 12 at the base of the opening 20. Likewise, friction fit tabs 17*c*, 17*d* and 17*e* (as best shown in FIG. 6) are formed on the inner side of the bottom trim 16 to frictionally fit onto the base of the housing 12. The snap fit of the grooves 17*a* and 17*b* and the tabs 17*c*, 17*d* and 17*e* allow the user to easily replace and remove the bottom trim and to hold the trim 16 securing into place on the housing 12.

The top trim 14 may be removably replaced onto the top surface 48 of the housing 12 by frictional fit around the structures formed in the top surface 48 of the housing 12. A battery recess 50 is configured to receive a rechargeable battery 52. A raised lip 54 is formed around the recess 50. Likewise, a raised lip 56 is formed around opening 58. As such, the top trim 14 has a handle opening 62 and a battery recess opening 64 wherein sidewalls of such openings engage the lips 54 and 56 to provide a frictional fit of the trim 14 onto the surface 48 of the housing 12. The lip 54 includes battery lip 54 recesses 66 that are adapted to receive rest pad 46 protrusions 68 (shown in FIG. 6) formed on the underside of the rest pad 46. When the rest pad 46 protrusions 68 engage the battery lip recesses 66, the rest pad 46 is removably fixed into place, overlapping the top trim 14 over the top trim opening 64, to provide a top cover for the battery recess 50 and holding the battery 52 in place in the battery recess 50 formed in the housing 12.

The battery 52 is a rechargeable lithium ion battery with a long life, and the need to change the battery may be infrequent depending on use and battery quality. The battery recess 50 adapted to hold the battery 52 in place and is enclosed by the rest pad 46 and allows a user easy access to the battery 52 for replacement without the need for a technician or repair person. Inserted in the proper configuration the battery 52 contacts 70 to align with electrical contacts 72 located in the battery recess 50 to provide power to the device 10 when in battery power mode. The electrical contacts 72 may be spring loaded to provide additional secure fit of the battery 52 into the recess 50. Also, battery 52 incudes a positioning tab 74 formed on the battery 52 casing that engages a positioning detent 76 formed at the end of the battery recess 52 opposite of the recess electrical contacts 72 so that the battery 52 can only be received in a single orientation or single direction, further making battery replacement user friendly.

Figure 5:
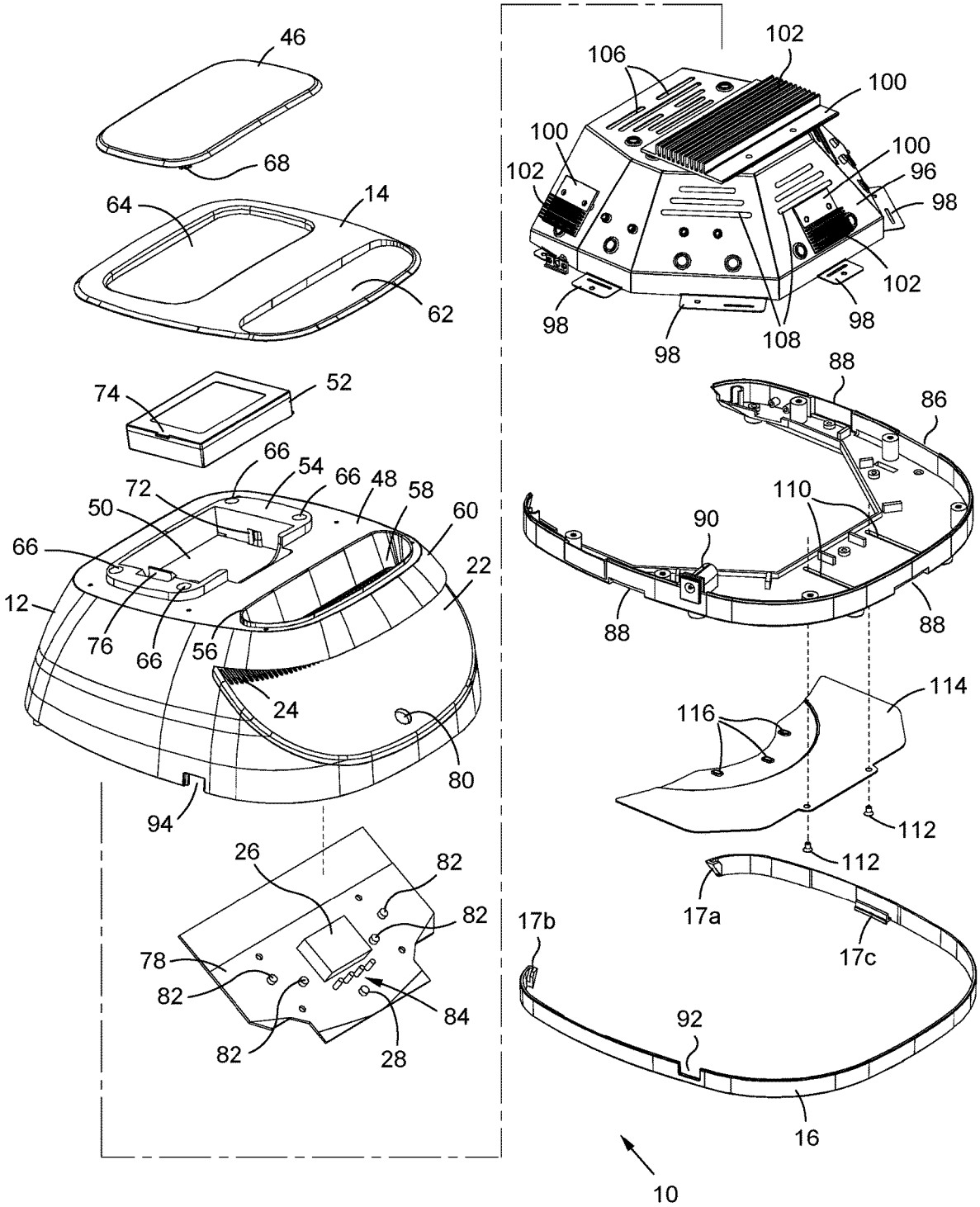
FIG. 5 is an exploded top perspective view of components of the nail lamp.

Referring particularly to FIGS. 5 and 6 there are shown a front top perspective exploded view and a bottom perspective exploded view, respectively. In addition to the user removable components discussed shown in FIGS. 3 and 4, FIGS. 5 and 6 shows exploded internal components of the device 10. A control board 78 is positioned within the housing 12 behind the control face 22. The control board includes the power button 28 that is accessible and protrudes through aperture 80 formed in the control face 22. The digital LCD readout 26 is visible through control face 22, wherein control face 22 has portions formed of a plastic or glass material allowing visibility of elements below the face 22, including the digital readout 26. Note the control face 22 shown in FIG. 5 may have information indicia printed on the control face 22 as shown in FIGS. 1, 3 and 4. The control board 78 includes button interfaces 82 that correspond to buttons 30, 32, 34 and 36 as described and shown with regard to FIG. 1. The button interfaces 82 reside below the control face 22 and are adapted to receive input through a user touch on the control face 22 at the locations specified by buttons 30, 32, 34 and 36 (see FIG. 1). The control board 78 also includes LED indicators 84 that correspond to the battery indicators 38, 40, 42 and 44 which are discussed and shown with regard to FIG. 1. The LED indicators 84 are visible through control face 22, as the control face 22 has at least portions formed of glass or plastic allowing the LED indicators 84 to be visible therethrough.

The housing 12 interfaces and interconnects with a housing base 86. The housing base includes recesses 88 formed into the unitary housing base 86 to allow tabs 17*c*, 17*d* and 17*e* to releasably engage with the device 10. A power port 90 is positioned on the base 86 to connect the device 10 to a power chord to provide power to the device 10 during operation or for charging the battery 52. The power port 90 is in electrical communication with electrical contacts 72 positioned within the batter recess 50, as well as other electrical components of the device, including the control board 78, and LED light boards positioned in different locations in the interior of the device 10. Likewise, the battery 52 is in electrical communication with the various electrical components of the device 10 to supply power. A notch 94 is formed in housing 12 to provide clearance for the power port 90. Likewise, the bottom trim 16 includes a notch 92 to provide clearance for the power port 90 when it is attached to the device 10.

An interior housing 96 is also shown exploded from the device 10. The interior housing 96 is formed from metal such as aluminum or other suitable metal substance. The inner surface of the interior housing may include a reflective surface to augment the LEDs that emit light within the interior housing. The metal interior housing 96 has a number of fastener tabs 98 formed around the base of the interior housing 96 to allow fasteners such as screws to connect the interior housing 96 to the housing base 86. The interior housing 96 has a series of LED modules 100, which can also be described as LED light boards, coupled to the exterior side of the interior housing 96. The modules 100 comprise LED controllers (not shown) and heat sinks 102. The modules 100 control LEDs 104 positioned in various locations within the interior of the interior housing 96 and are in electrical communication with a control board 78 and power supply. The modules 100 have heat sinks positioned on the top of the light board, away from the interior housing 96, and the modules 100 are attached to the interior housing 96, and LEDs 104 formed on the opposite side of the light board of the module 100, that are exposed to the interior chamber of the interior housing 96 by openings 105 formed in the interior housing. Each of the LEDs 104 are exposed through the interior housing 96 by openings 105. The top of the interior housing 96 has vents 106, along with vents 108 to dissipate heat. The LEDs 104 may have a 400 nm wavelength, attached to a ceramic substrate, formed into a 3535 package. Although 400 nm LEDs are disclosed, any suitable wavelength may be used that is effective in curing nail gel. Effective ranges of LED for curing include but are not limited to 320 nm to 400 nm and as such LEDs in this range may be utilized. However, different nail gels require different curing wavelengths, and the LEDs could be substituted at different wavelengths to suit gel curing requirements. For example, UV light generally ranges from 100 nm and 400 nm and LEDs in this range may be suitable depending on gel requirements.

The housing base 86 also includes slots 110 that engage with slide fasteners 112 to attach slide plate 114 to the housing base 86. The slide plate 114 is movable as discussed in greater detail with regard to FIGS. 9 and 10.

Figure 7:
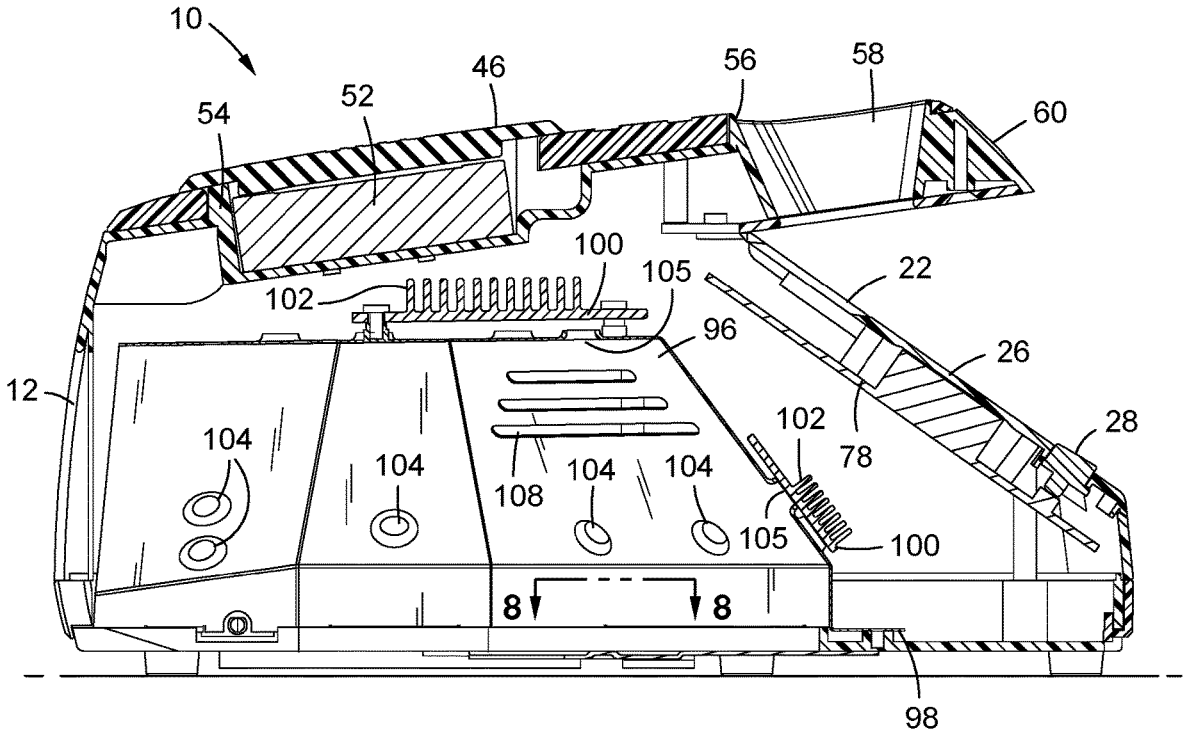
FIG. 7 is a cross sectional view of cross section 7-7 of FIG. 2 of the nail lamp.
Figure 8:
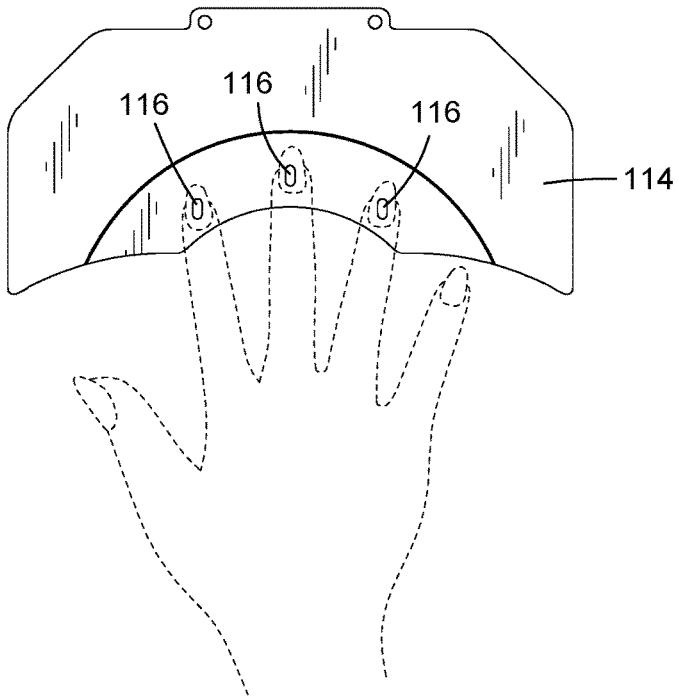
FIG. 8 is a top view of the base plate of the nail lamp.

Referring to FIG. 7, there shown a cross section view along of the device 10 along line of sight 7-7 as shown in FIG. 2. FIG. 8 shows a top view of slide plate 114 along sight line 8-8 shown in FIG. 7. Slide plate 114 includes three raised protrusions 116 to provide a tactile feel for a user to indicate to the user that a hand is properly positioned within the device 10. For example, a user places his or her hand within the device 10 and is unable to see the location of the hand. As such the protrusions 116 provide an indication of proper location.

Figure 9:
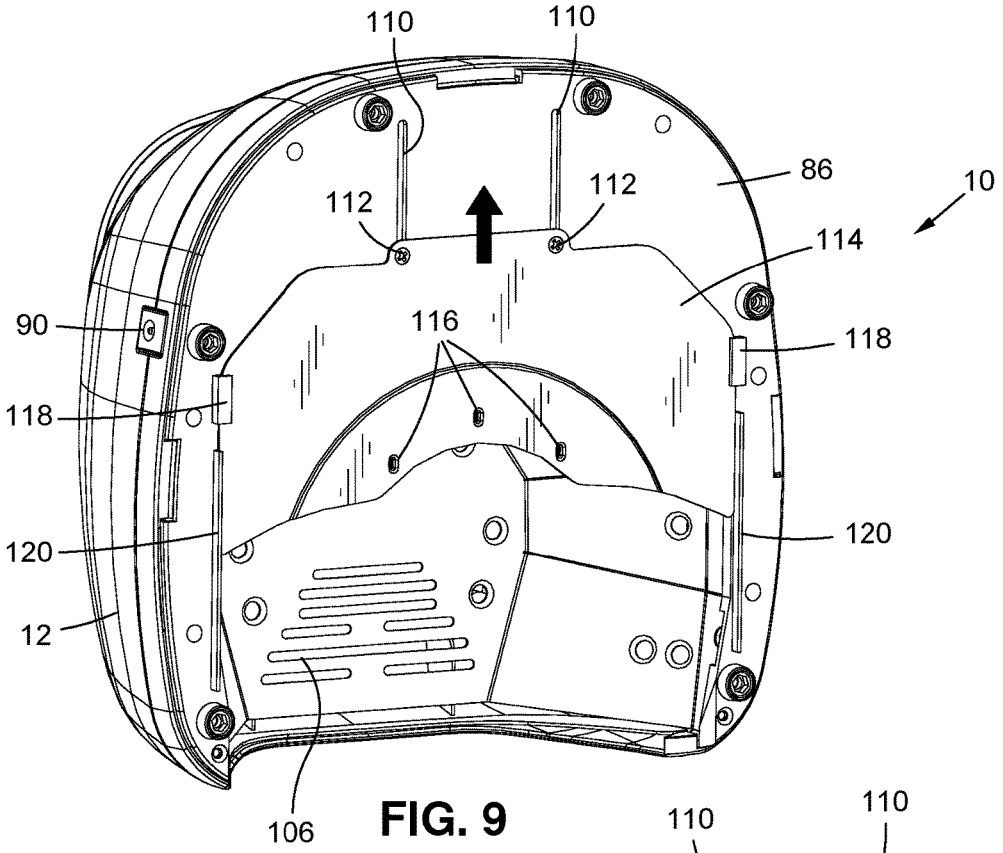
FIG. 9 is a bottom view of the nail lamp showing the base plate in a first position.
Figure 10:
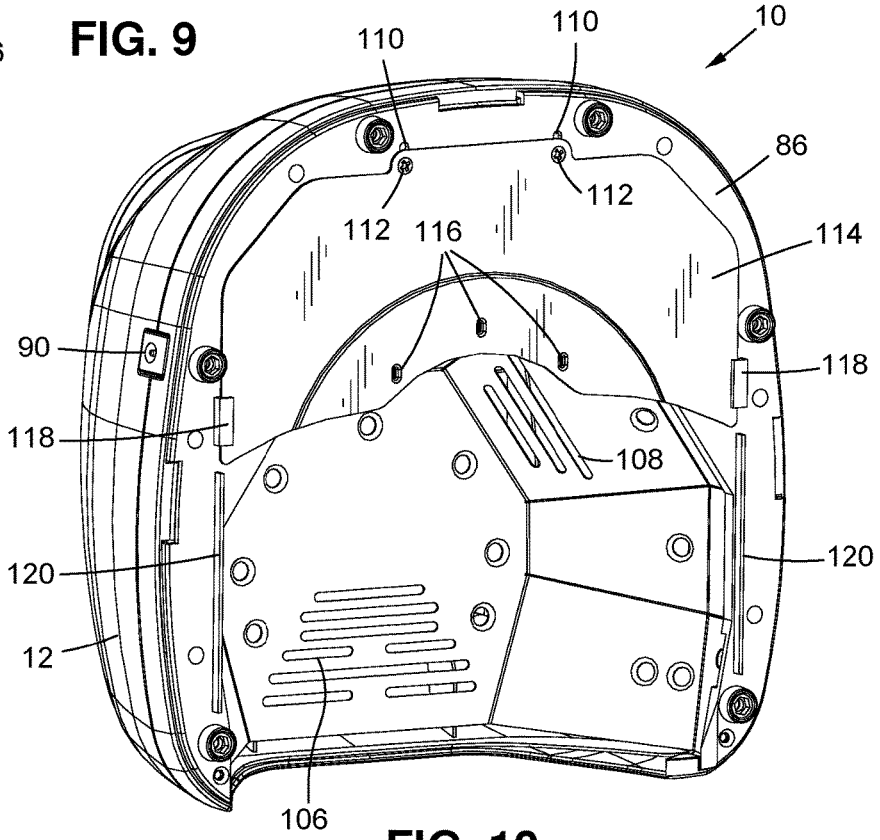
FIG. 10 is a bottom view of the nail lamp showing the base plate in a second position.

Referring to FIGS. 9 and 10, there is shown a bottom view of the assembled device 10. FIG. 9 shows the position of the slide plate 114 in operation of the device during a drying or curing of fingernails for a hand. FIG. 10 shows the position of the slide plate 114 during a drying or curing of toenails of a foot. In this regard, the slide plate 114 is slidably fastened to the base 86 of the device 10 by slide fasteners 112 that are slidably attached to slots 110 formed in the base 86. FIG. 9 represents the first hand curing position, and the arrow indicates the direction of sliding of the plate 114 to reposition the slide plate 114 to a second foot drying/curing position as shown in FIG. 10. Retention tabs 118 hold the plate 114 in position from moving downward or dropping toward a table or other surface in which the device 10 is positioned. The retention tabs 118 slidably receive the plate 114 and support the plate. In addition, side rails 120 prevent the plate from moving laterally.

The above description is given by way of example, and not limitation. Given the above disclosure, one skilled in the art could devise variations that are within the scope and spirit of the disclosure herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A gel lamp comprising:

a housing having an open cavity, the open cavity having an inner side;

at least one light emitting diode (LED) positioned on the inner side of the open cavity;

at least one control module for controlling operation of the at least one LED;

a base coupled to the housing, said base comprising at least one elongate slot; and a base plate attached to the base by at least one slidable fastener received within said at least one elongate slot, said base plate being configured to be translatable relative to the base between a first position to a second position.

2. The gel lamp of claim 1 wherein the base comprises at least two elongate slots.

3. The gel lamp of claim 2 wherein the base plate is attached to the base by at least two slidable fasteners received within said at least two elongate slots.

4. The gel lamp of claim 1 wherein the base plate comprises at least one tactile surface for aligning a finger onto the base plate.

5. The gel lamp of claim 1 wherein the base further comprises side rails formed to reduce lateral movement of the base plate.

6. The gel lamp of claim 1 wherein the base further comprises retention tabs to support the base plate in proximity to the base, while allowing movement of the base plate.

7. The gel lamp of claim 1 having a battery for powering the control module and LEDs.

8. The gel lamp of claim 1 wherein the housing further comprises a handle member extending from the housing.

9. The gel lamp of claim 1 wherein the housing has a front end and a rear end, the rear end having an opening for receiving a hand or foot.

10. The gel lamp of claim 1 wherein the housing has a rear end and a front end, the front end having a control interface.

11. The gel lamp of claim 10 wherein the front end of the housing has a handle member extending therefrom.

12. The gel lamp of claim 11 wherein the handle member extends above the control interface.

13. The gel lamp of claim 1 wherein the control module adjusts an intensity of LEDs based on a timing selection input into a control interface.

14. A gel lamp comprising;

a housing having an open cavity and a trim attachment region, the open cavity having an inner side;

at least one light emitting diode (LED) positioned on the inner side of the open cavity;

at least one control module for controlling operation of the at least one LED;

a first trim piece configured to be releasably securable to the housing at the trim attachment region, the first trim piece having a first appearance; and a second trim piece, identical in structure to the first trim piece, and configured to be releasably securable to the housing at the trim attachment region, the second trim piece having a second appearance;

the first trim piece and second trim piece being configured to be interchangeably securable to the housing at the trim attachment region such that the first trim piece is releasably securable to the housing at the trim attachment region when the second trim piece is detached from the trim attachment region, and the second trim piece is releasably securable to the housing at the trim attachment region when the first trim piece is detached from the trim attachment region.

15. The gel lamp of claim 14 wherein the first appearance of the first trim piece is a first color and the second appearance of the second trim piece is a second color.

16. The gel lamp of claim 14 wherein the first appearance of the first trim piece is a first texture and the second appearance of the second trim piece is a second texture.

17. The gel lamp of claim 14 wherein the housing further comprises a handle member extending from the housing.

18. The gel lamp of claim 14 wherein the housing has a front end and a rear end, the rear end having an opening for receiving a hand or foot.

19. The gel lamp of claim 14 wherein the housing has a rear end and a front end, the front end having a control interface.

20. The gel lamp of claim 14 wherein the front end of the housing further comprises a handle extending from the housing.

21. The gel lamp of claim 20 wherein the handle extends above the control interface.

* * * * *